US009878415B1

(12) United States Patent
Durell et al.

(10) Patent No.: US 9,878,415 B1
(45) Date of Patent: Jan. 30, 2018

(54) PORTABLE SKI AND SNOWBOARD EDGE SHARPENER

(71) Applicant: Durell Laboratories, Inc., Las Vegas, NV (US)

(72) Inventors: William E. Durell, Las Vegas, NV (US); Thomas E. Durell, Denver, CO (US)

(73) Assignee: Durell Laboratories, Inc., Las Vegas, NV (US)

( * ) Notice: Subject to any disclaimer, the term of this patent is extended or adjusted under 35 U.S.C. 154(b) by 78 days.

(21) Appl. No.: 14/804,490

(22) Filed: Jul. 21, 2015

Related U.S. Application Data

(60) Provisional application No. 61/999,259, filed on Jul. 22, 2014.

(51) Int. Cl.

| | |
|---|---|
| ***B24B 3/00*** | (2006.01) |
| ***B24B 55/04*** | (2006.01) |
| ***B24B 55/06*** | (2006.01) |
| ***B24B 55/05*** | (2006.01) |
| ***B24B 27/00*** | (2006.01) |
| ***B24B 55/10*** | (2006.01) |

(52) U.S. Cl.
CPC ..... *B24B 3/006* (2013.01); *B24B 27/0084* (2013.01); *B24B 55/04* (2013.01); *B24B 55/052* (2013.01); *B24B 55/06* (2013.01); *B24B 55/102* (2013.01)

(58) Field of Classification Search
CPC ..... B24B 3/003; B24B 3/006; B24B 3/024; B24B 9/04; B24B 25/02; B24B 27/0084; B24B 41/02; B24B 55/052; B24B 55/102; B24D 15/068
See application file for complete search history.

(56) References Cited

U.S. PATENT DOCUMENTS 2,821,815 A * 2/1958 Banko ..... B24B 27/0084 451/150
2,926,461 A * 3/1960 Banko ..... B24B 27/0084 451/150
3,512,308 A * 5/1970 Schell, Jr. ..... A63C 11/06 451/349
4,241,544 A * 12/1980 Hampton ..... B24B 3/003 451/120

(Continued)

*Primary Examiner* — Timothy V Eley
(74) *Attorney, Agent, or Firm* — Greenberg Traurig LLP

(57) ABSTRACT

A portable ski and/or snowboard edge sharpener and method. The edge sharpener includes an abrasive grinding wheel, a belt driven drive train that connects the electric motor and the grinding wheel drive mechanism and decreases the grinding wheel's speed of rotation relative to the rotational speed of the motor, a grinding wheel mount allowing the operator to select and use grinding wheels of different grits and materials and grinding wheel control mechanisms allowing the operator to control the cut depth and the grinding wheel angles relative to the longitudinal and transverse planes of the ski edge surface to be sharpened. This configuration allows the operator to repeatedly sharpen a ski edge at a specific and chosen angle with a specific and chosen surface finish. Other features include, position lockdown devices being part of each of the control mechanisms and a vacuum system to capture residue from the grinding operation.

21 Claims, 9 Drawing Sheets

(56) References Cited

U.S. PATENT DOCUMENTS

| | | | | | |
|---|---|---|---|---|---|
| 4,665,778 | A * | 5/1987 | Lubin | A63C 11/06 | 407/29.15 |
| 4,934,108 | A * | 6/1990 | Hall | B24B 3/38 | 451/358 |
| 6,086,465 | A * | 7/2000 | Mayr | A63C 11/06 | 451/260 |
| 6,953,394 | B2 * | 10/2005 | Wendt | B23Q 11/0046 | 30/390 |
| 7,530,879 | B2 * | 5/2009 | Wagner | A63C 11/06 | 451/10 |
| 8,162,726 | B1 * | 4/2012 | Jorgensen | B24B 9/06 | 451/344 |
| 8,616,938 | B1 * | 12/2013 | Mills | B24B 23/02 | 451/349 |
| 9,102,031 | B2 * | 8/2015 | Page | B24B 27/0015 | |
| 2006/0286910 | A1 * | 12/2006 | Voigt | B24B 55/052 | 451/359 |
| 2010/0330889 | A1 * | 12/2010 | Thibault | B24B 3/006 | 451/439 |
| 2014/0352106 | A1 * | 12/2014 | King, Jr. | B28D 7/02 | 15/415.1 |

* cited by examiner

PORTABLE SKI AND SNOWBOARD EDGE SHARPENER

CROSS-REFERENCE

This application claims priority to Patent Application No. 61/999,259 filed Jul. 22, 2014 which is incorporated herein for any and all purposes.

FIELD OF THE INVENTION

The embodiments of the present invention generally relate to a device that offers a portable method for sharpening ski and snowboard edges in the field as well as in the shop.

BACKGROUND

Sharp metal edges are required to maximize the performance potential of a ski. The frequency and quality of edge sharpening is generally geared to the requirements of the ski and skier as well as the conditions they typically encounter. Soft, natural snow does not require particularly sharp edges, nor does it tend to dull a ski's edges very quickly when skied upon. Conversely, hard, man-made snow and water-injected race courses require very sharp ski edges and also cause ski edges to dull relatively quickly.

Depending on the skier's skill level and preference, and local conditions, the skier may choose to sharpen the ski edge to less than 90 degrees to increase the performance of the ski. The angle generally falls between 85 and 89 degrees depending upon the type of skis, the anticipated hardness of the snow and the skier's skill level and preference.

Precise repeatability and accuracy is desirable in any ski sharpening tool, but especially those used by experts and racers who may have several pairs of skis that are sharpened frequently. In such cases, the edge angle, sharpness and finish applied to the ski edge by the sharpening tool must be as close in quality and accuracy as the last sharpening, and be consistent between edges and across skis in order to provide the skier with the expected uniformity and performance level.

Most current models of powered ski edge sharpeners require a plug-in electrical source which limits their use to an area where an electrical outlet is available, have limited repeatability and accuracy, are relatively expensive or have some combination of these drawbacks.

Thus, it would be advantageous to develop a new ski edge sharpener for overcoming the aforementioned drawbacks and others.

SUMMARY

A ski edge sharpener according to the embodiments of the present invention comprises an abrasive grinding wheel (precision made and super abrasive in one embodiment), a belt driven drive train that connects the electric motor and the grinding wheel drive mechanism and decreases the grinding wheel's speed of rotation relative to the rotational speed of the motor, a grinding wheel mount allowing the operator to select and use grinding wheels of different grits and materials and grinding wheel control mechanisms allowing the operator to control the depth of cut and the grinding wheel angles relative to the longitudinal and transverse planes of the ski edge surface to be sharpened. This configuration allows the operator to repeatedly sharpen a ski edge at a specific and chosen angle with a specific and chosen surface finish. In one embodiment, position lock-down devices are a part of each of the control mechanisms. In another embodiment, the ski edge sharpener also includes a vacuum system to capture residue from the grinding operation. Advantageously, the ski edge sharpener described herein is a battery-operated, rechargeable device providing portability which prior art plug-in devices lack.

Other variations, embodiments and features of the present invention will become evident from the following detailed description, drawings and claims.

DETAILED DESCRIPTION

Figure 1:
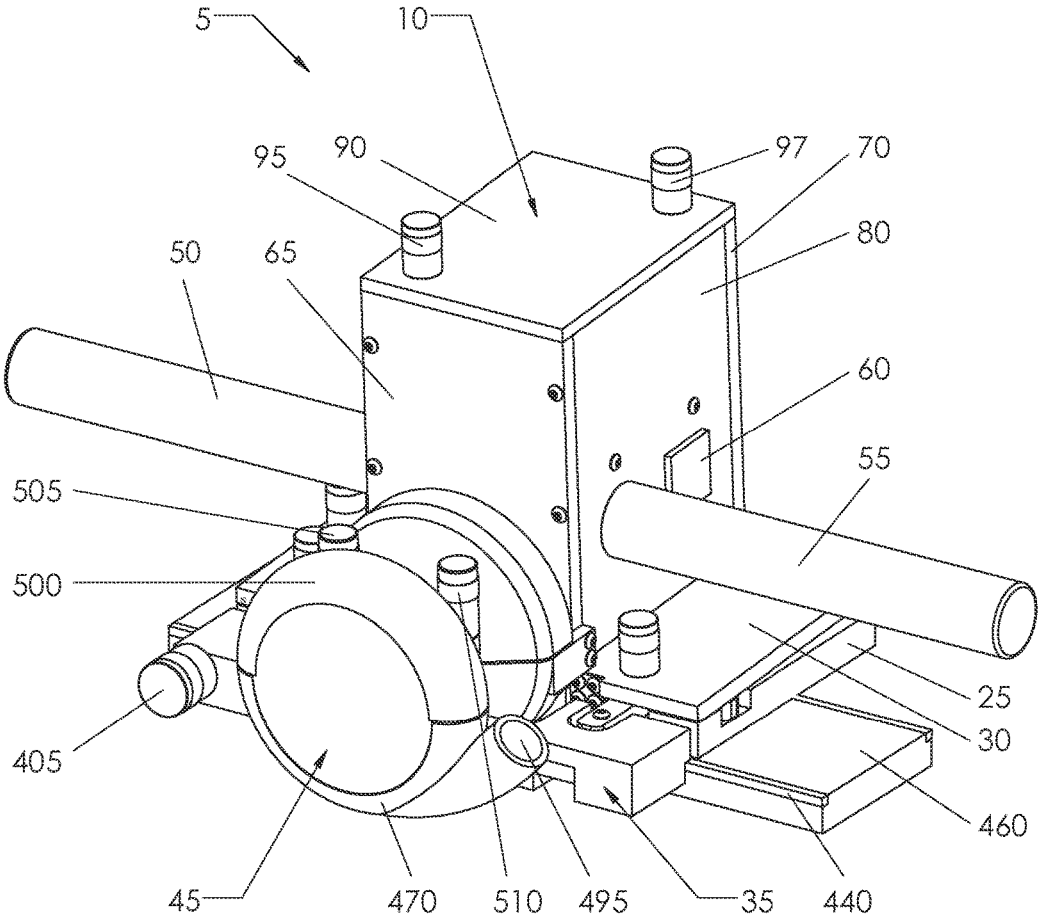
FIG. 1 illustrates an isometric view of the overall ski edge sharpener according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The term 'ski' as used herein refers to any ski or snowboard with metal edges designed to be sharpened. The term 'skier' as used herein refers to the user of the skis or snowboard. The term 'operator' as used herein refers to the user of the ski edge sharpener. The components of the ski edge sharpener may be made of any suitable material including, but not limited to, metals, alloys, composites, polymers and combinations thereof. The components of the ski edge sharpener may be fabricated using any suitable technique including, but not limited to, molding, casting, machining, additive processes and combinations thereof.

As shown in FIG. 1, ski edge sharpener 5 comprises a drive and battery case 10, drive assembly 15, battery pack assembly 20, base plate 25, tilt plate assembly 30, edge guide assembly 35, arbor assembly 40, grinding wheel guard and vacuum assembly 45, handles 50 and 55 and on-off switch 60.

Drive and battery case or housing 10 comprises a drive and battery case front plate 65, drive and battery case rear plate 70, drive and battery case left plate 75, drive and battery case right plate 80, drive case top plate 85 and battery case top cover 90. Drive and battery case plates 65, 70, 75, 80 and drive case top plate 85 are rigidly affixed to one another. The case may completely or partially contain the components, such as the drive assembly 15, battery pack assembly 20 and motor 105, etc. Battery case top cover 90, which affords easy access for replacement or charging battery pack assembly 20, is attached to the top of drive and battery case 10 by top cover attachment screws 95 and 97.

Battery pack assembly 20 sits on top of drive case top plate 85. Two wires (not shown) pass from battery pack assembly 20 through wire hole 100 in drive case top plate 85 and connect to motor 105. One of the wires (not shown) is connected in series through on-off switch 60 prior to connecting to motor 105. On-off switch 60, when in the on position, completes the electric circuit from battery pack assembly 20 to motor 105.

Figure 2:
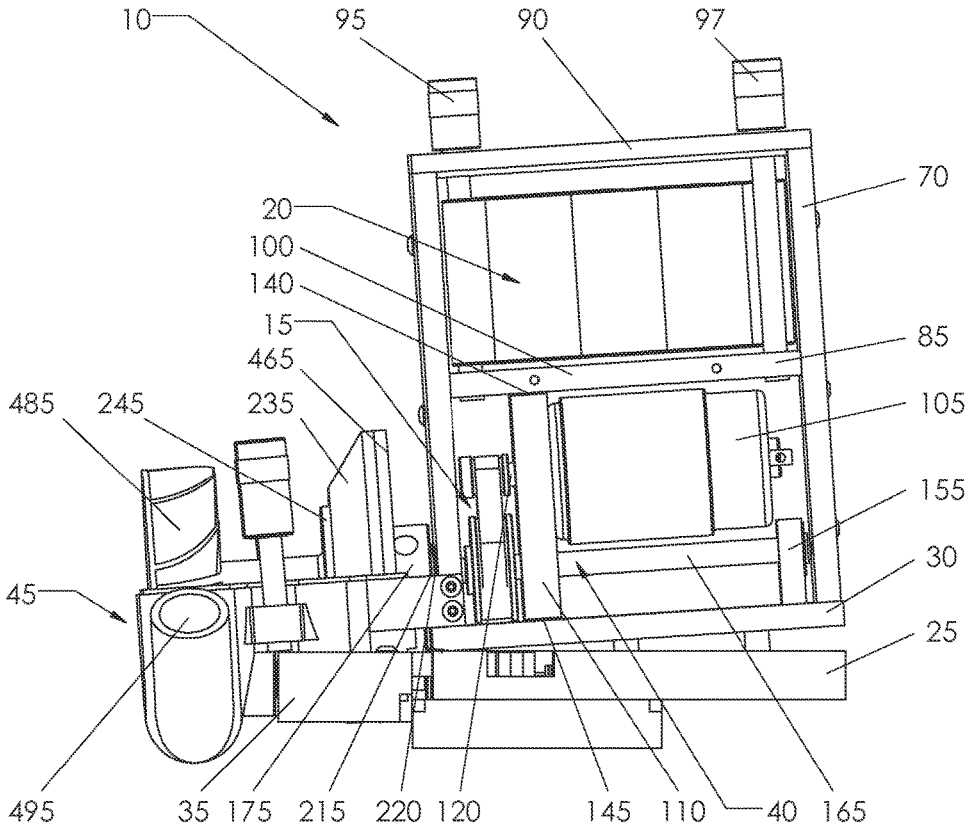
FIG. 2 illustrates a right side view of the ski edge sharpener with the drive and battery case right plate, right handle, the top wheel guard and vacuum cover, switch and right edge guide lock down screw removed for observing internal aspects of the ski edge sharpener according to the embodiments of the present invention.
Figure 3:
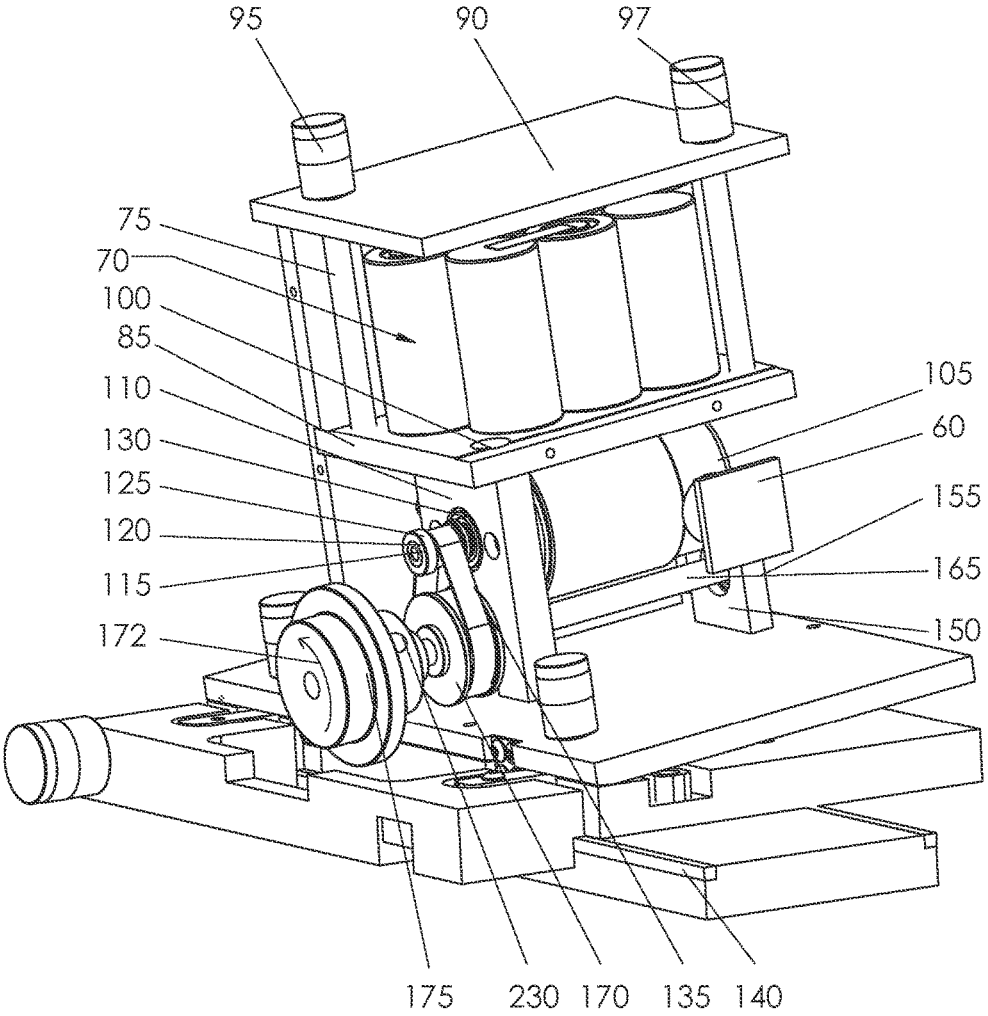
FIG. 3 illustrates a right front side isometric view of the ski edge sharpener with the drive and battery case rear plate, right plate and front plate, grinding wheel guard and vacuum assembly, grinding wheel and right handle removed for observing internal aspects of the ski edge sharpener according to the embodiments of the present invention.
Figure 4:
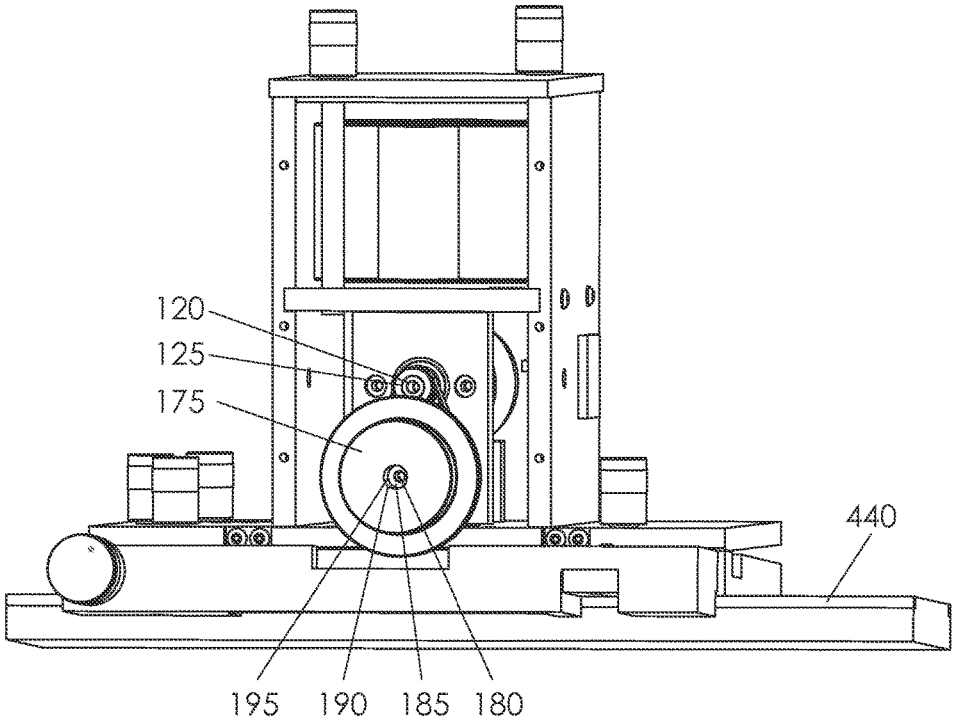
FIG. 4 illustrates a right front isometric view of the ski edge sharpener with the drive and battery case front plate, grinding wheel guard, vacuum assembly and right handle removed for observing internal aspects of the ski edge sharpener according to the embodiments of the present invention.
Figure 5:
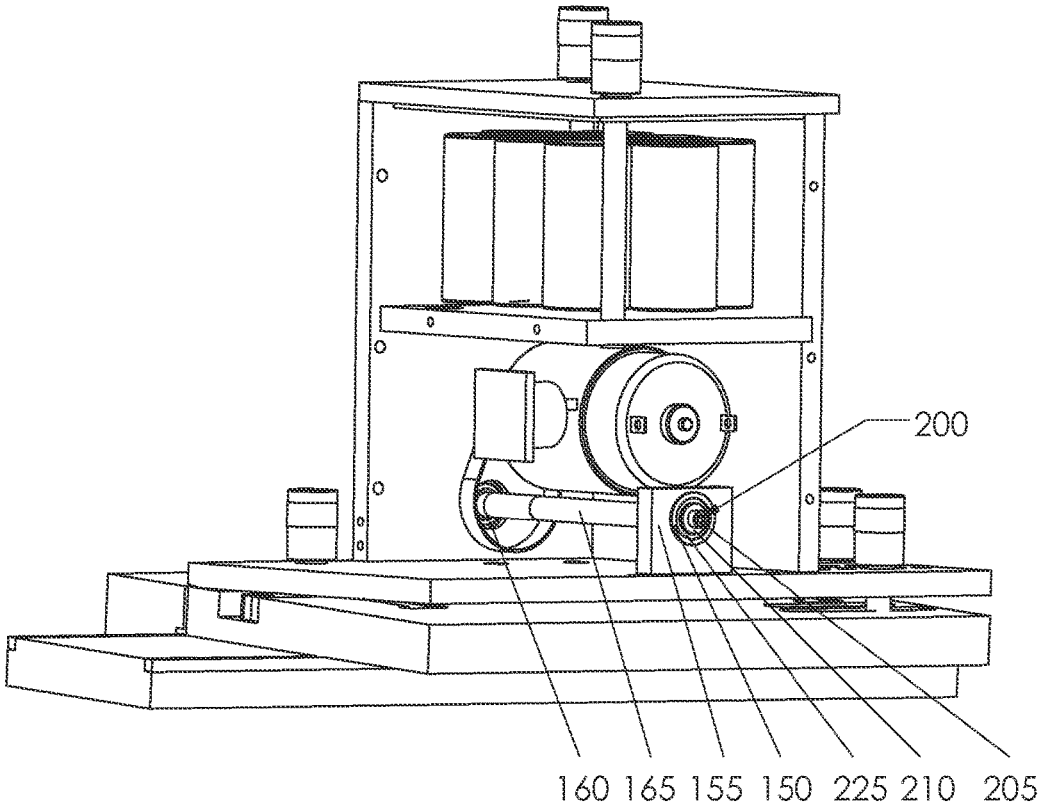
FIG. 5 illustrates a right rear isometric view of the ski edge sharpener with the drive and battery case rear plate and right plate, motor mount and right handle removed for observing internal aspects of the ski edge sharpener according to the embodiments of the present invention.

Now referring to FIGS. 2-4 which each show internal aspects of the ski edge sharpener 5, motor 105 is rigidly attached to motor mount 110. Attached to the motor shaft (not shown) is motor shaft bushing 120. Attached to motor shaft bushing 120 is motor pulley 125. Motor mount bearing 130 is press fit into motor mount 110. Motor shaft bushing 120 passes through and is supported by motor mount bearing 130 which absorbs transverse loads placed on motor shaft 115 by drive belt 135, preventing the transverse loads from being placed on the motor shaft internal bushing (not shown). '0' rings (not shown) are placed in recesses (not shown) along motor mount top surface 140 and motor mount bottom surface 145. Such an arrangement allows for vibration dampening caused by the rotation of motor 105.

As best shown in FIG. 3, rear bearing 150 is press fit into arbor shaft rear bearing support 155. Front bearing 160 is press fit into drive and battery case front plate 65. Arbor shaft 165 is supported by rear bearing 150 and front bearing 160. Attached to arbor shaft 165 is arbor pulley 170. Drive belt 135 goes around motor pulley 125 and arbor pulley 170 and transmits the counter-clockwise rotational drive, as depicted by arrow 172, from motor 105 to arbor pulley 170. The counter-clockwise rotational speed difference between motor 105 and arbor shaft 165 is controlled by the relative size differences between motor pulley 125 and arbor pulley 170.

As best shown in FIG. 4, arbor 175 is mounted on arbor shaft 165. Arbor front bolt 180 passes through arbor washer 185 and threads into arbor shaft proximal end 190. Arbor washer 185 presses against arbor inner shoulder 195. At arbor shaft distal end 200, arbor shaft rear bolt 205 passes through arbor shaft rear washer 210 and threads into arbor shaft distal end 200. The tightening of the arbor shaft rear bolt 205 causes arbor outer shoulder 215 to come in contact with front bearing inner race 220 and arbor shaft rear washer 210 to come in contact with rear bearing inner race 225. Additional tightening of the arbor shaft rear bolt 205 causes bearing inner races 220 and 225 to be drawn toward one another thereby removing any horizontal movement in arbor shaft 165. When all undesirable horizontal movement in arbor shaft 165 has been removed, the adjustment is complete. Once horizontal movement of arbor shaft 165 is eliminated, arbor 175 is then rigidly affixed to arbor shaft 165 by arbor set screw 230. Grinding wheel 235 is then rigidly attached to arbor 175 by grinding wheel attachment bolt 240 passing through fender washer 245 and screwing into arbor 175.

Figure 7:
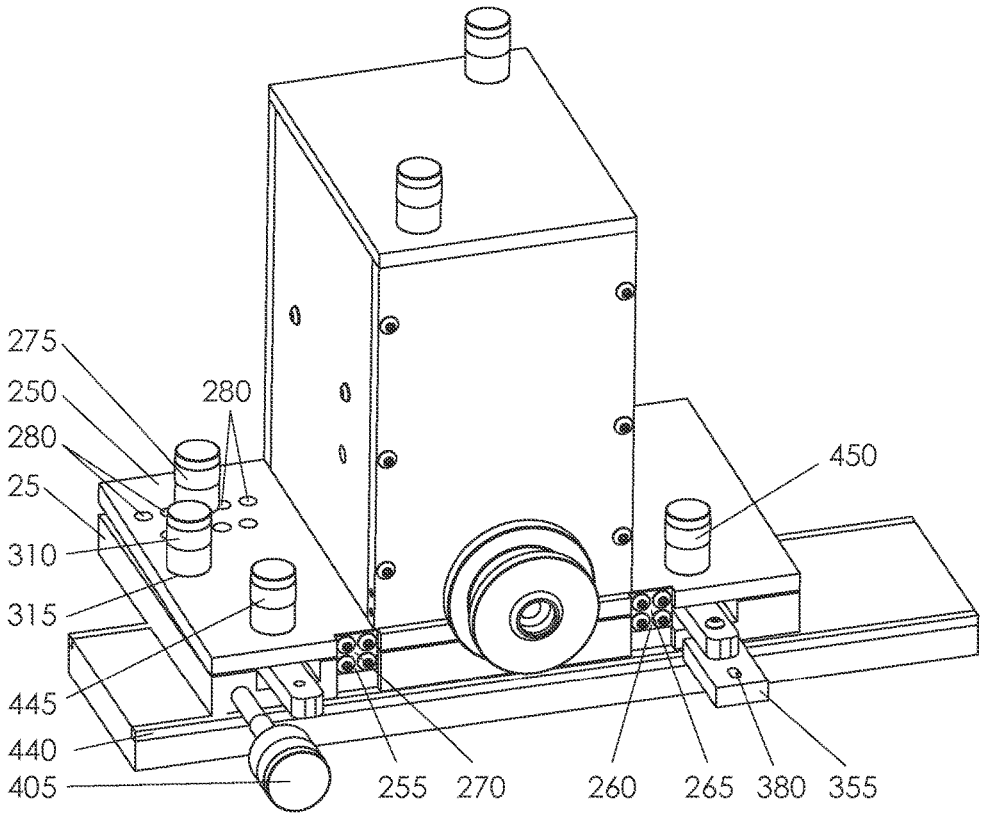
FIG. 7 illustrates a left front isometric view of the ski edge sharpener with the edge guide, grinding wheel guard and vacuum assembly, grinding wheel and left and right handles removed for observing internal aspects of the ski edge sharpener according to the embodiments of the present invention.

Now referring to FIG. 7, tilt plate 250 is connected to base plate 25 by leaf spring hinges 255 and 260. Leaf spring hinges 255 and 260 are rigidly attached to tilt plate 250 and rigidly attached to base plate 25. With such an arrangement, tilt plate 250 is rigidly attached to base plate 25 except for rotational movement allowed by leaf spring hinges 255 and 260 around leaf spring hinge flex points 265 and 270.

Figure 8:
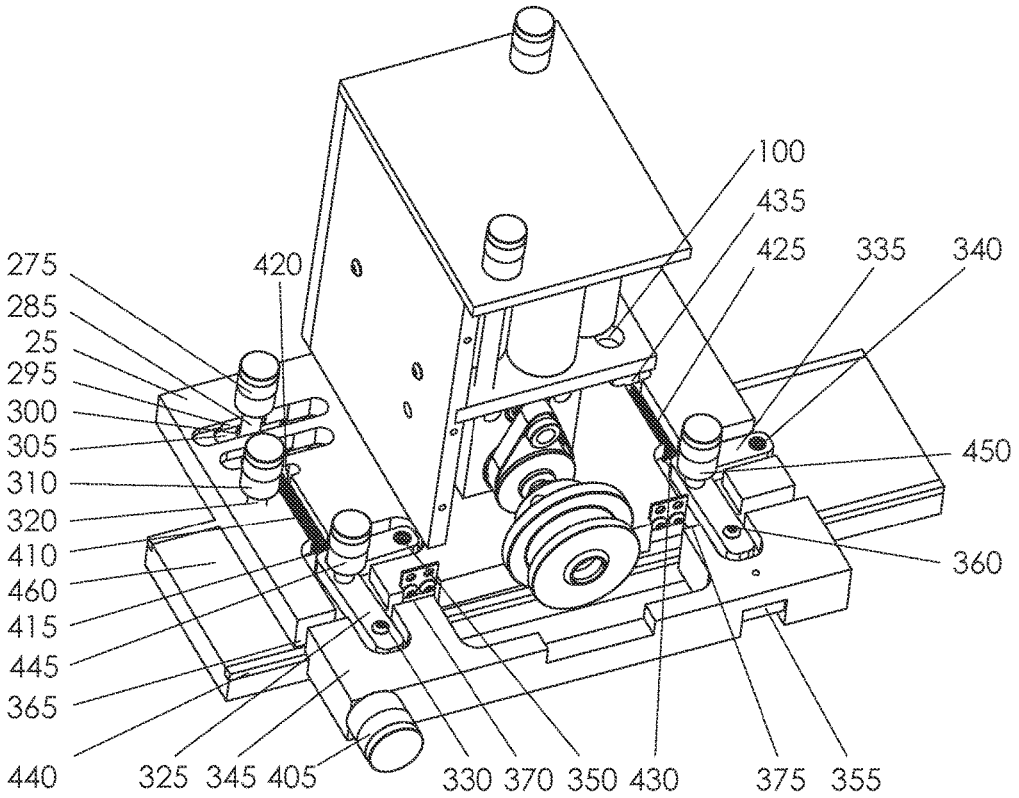
FIG. 8 illustrates a left front isometric view of the ski edge sharpener with the tilt plate, gear and battery case front and right plates, grinding wheel guard and vacuum assembly and left and fight handles removed for observing internal aspects of the ski edge sharpener according to the embodiments of the present invention.

As best shown in FIG. 8, left edge guide hinge 325 is attached to base plate 25 by left edge guide hinge retaining screw 330. Right edge guide hinge 335 is attached to base plate 25 by right edge guide hinge retaining screw 340. In one embodiment, left edge guide hinge 325 and right edge guide hinge 335 are identical. Left edge guide hinge 325 is attached to edge guide 345 by left edge guide hinge retaining screw 350. Right edge guide hinge 335 is attached to edge guide slide 355 by right edge guide hinge retaining screw 360. Left edge guide hinge 325 is allowed to rotate around retaining screws 330 and 350. Right guide hinge is allowed to rotate around retaining screws 340 and 360. Based on this arrangement, the fixed angle between base plate surface 365 and edge guide surfaces 370 and 375, which are coplanar with each other, remains constant throughout the range of motion of edge guide 345.

The angle between base plate surface 365 and edge guide surfaces 370 and 375 can be adjusted by changing the position of edge guide slide 355 in edge guide slot 380. This adjustment is held in place by edge guide slide adjustment screw 385 passing through slot 390 in edge guide slide 355 and threading into edge guide 345.

Figure 9:
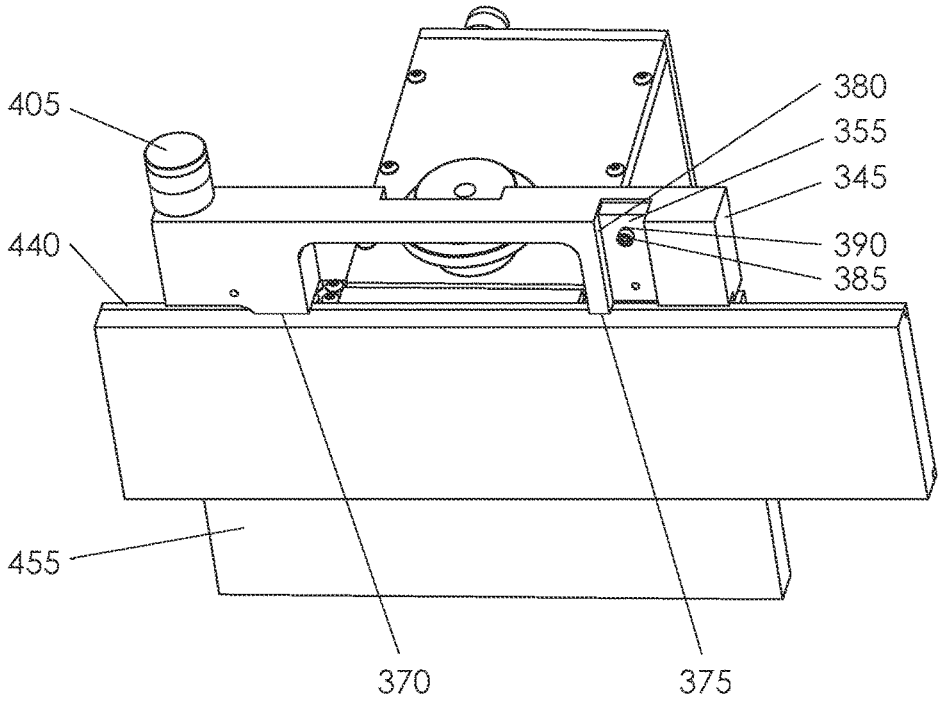
FIG. 9 illustrates a right front bottom isometric view of the ski edge sharpener with the grinding wheel, grinding wheel guard and vacuum assembly, and left and right handles removed for observing internal aspects of the ski edge sharpener according to the embodiments of the present invention.

Now referring to FIG. 9, edge guide adjustment screw 405 is threaded through edge guide 345 and contacts base plate surface 365. Adjusting edge guide adjustment screw 405 moves edge guide 345 toward or away from base plate 25. Left hinge return spring 410 is attached to left edge guide hinge 325 at 415 and to base plate 25 at 420. Right hinge return spring 425 is attached to right edge guide hinge 335 at 430 and to base plate 25 at 435. Hinge return springs 410 and 425 pull edge guide hinges 325 and 335, respectively, closing the gap between edge guide surfaces 370 and 375 and base plate surface 365. Edge guide adjustment screw 405 works against the pull of return springs 410 and 425 giving edge guide adjustment screw 405 control over the distance between edge guide surfaces 370 and 375 and base plate surface 365. This adjustment controls the depth of cut grinding wheel 235 will make on ski edge 440. When edge guide 345 is in the proper position, both left edge guide hinge clamp screw 445 and right edge guide hinge clamp screw 450 are tightened locking edge guide 345 into the selected position.

In operation, grinding wheel 235 can be tilted from a vertical orientation by tilt adjustment screw 275 and locked in the selected tilt position by tilt plate lock down screw 310. Grinding wheel 235 can be rotated horizontally in relation to ski edge 440 by adjusting the location of edge guide slide 355. The cut depth of grinding wheel 235 on ski edge 440 can be adjusted by adjusting edge guide adjustment screw 405 and locked in the selected cut depth position by edge guide clamp screws 445 and 450.

Figure 6:
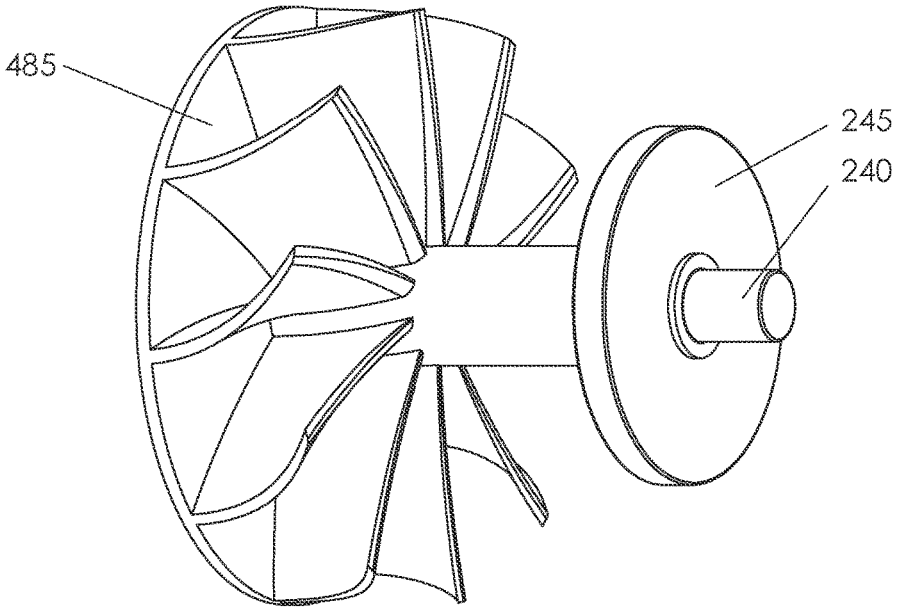
FIG. 6 illustrates an isometric view of the fan assembly of the ski edge sharpener according to the embodiments of the present invention.

Surrounding grinding wheel 235 is grinding wheel guard and vacuum assembly 45. Grinding wheel guard and vacuum assembly lower section 470 is rigidly attached to drive and battery case front plate 65. As best shown in FIG. 6, inserted into the end of fan 485 is grinding wheel attachment bolt 240 which passes through fender washer 245 and screws into arbor 175, thus securing both grinding wheel 235 and fan 485 in place. Since fan 485 and grinding wheel 235 are attached to each other, they rotate together. The rotation and design of fan 485 creates a vacuum around grinding wheel 240 and expels air through grinding wheel guard assembly 45 and out nozzle 495. The air flowing around grinding wheel 235 and into grinding wheel guard assembly 45 captures the residue from the grinding operation and expels it out through nozzle 495 into an attached collection bag (not shown). Grinding wheel guard and vacuum assembly upper section 500, when attached to grinding wheel guard and vacuum assembly lower section by grinding wheel guard and vacuum assembly hold down screws 505 and 510, close the grinding wheel guard and vacuum assembly. Removing grinding wheel guard and vacuum assembly upper section 500 by loosening upper section hold down screws 505 and 510 gives access to fan 485 and grinding wheel 235. Unscrewing fan 485 from grinding wheel 235 allows for the removal and replacement of grinding wheel 235.

In operation, tilt adjustment screw 275 is placed in the desired tilt adjustment hole 280 and seated. Tilt plate lock down screw 310 is then seated in a hole of tilt plate lockdown 315 thereby fixing the tilt angle of tilt plate 250 in relation to base plate 25. Adjusting the position of edge guide slide 355 fixes the horizontal angle between edge guide surfaces 370 and 375 and base plate surface 365. Adjusting edge guide adjustment screw 405 determines the depth of cut of grinding wheel 235. With the ski bottom surface 460 facing up and held in a horizontal position, the bottom surface 455 of base plate 25 slides along the ski bottom surface 460, edge guide surfaces 370 and 375 contact and slide along ski edge 440, and grinding wheel surface 465 is in contact with ski edge 440 at the proper vertical and transverse angles and at the proper depth. Handles 50 and 55 allow the operator to easily grip ski edge sharpener 5 during operation.

Because of the counter-clockwise-direction of rotation of grinding wheel 235, grinding induced burr creation has been and is greatly reduced. The absence of burrs reduces friction generated by the ski edge contacting the snow or ice and prevents jagged sections on the ski edges from forming when a burr breaks or chips off during ski use. In addition, the grinding wheel rotational speed, grinding wheel grit size and grinding wheel material combine to surface harden ski edge 440, thus prolonging and reducing the action of the snow or ice in dulling the edge sharpness. While counter-clockwise rotation is shown to greatly reduce grinding induced burrs, it is conceivable that in other embodiments, clockwise rotation may be used.

While the foregoing written description of the embodiments of the present invention enable one of ordinary skill to make and use what is considered presently to be the best mode thereof, those of ordinary skill will understand and appreciate the existence of variations, combinations, and equivalents of the specific embodiment, method, and examples herein. The invention herein should therefore not be limited by the above-described embodiments, methods, and examples, but by all embodiments and methods within the scope and spirit of the invention as claimed.

We claim:

1. A portable ski and/or snowboard edge sharpener comprising:

a battery positioned at least partially within a case;

a base plate beneath said case;

a grinding wheel;

a motor for driving said grinding wheel;

an edge guide proximate to said base plate, said edge guide for guiding an edge of a subject ski or snowboard into contact with said grinding wheel; and a tilt plate above and proximate to said base plate and supporting said case and grinding wheel, said tilt plate selectively movable about one end thereof such that an angle between said tilt plate and said base plate and a vertical angle between said grinding wheel and an edge of said subject ski or snowboard may be selectively adjusted and set.

2. The portable ski and/or snowboard edge sharpener according to claim 1 further comprising a pair of leaf spring hinges joining said tilt plate and said base plate, said leaf spring hinges permitting said tilt plate to rotate relative to said base plate.

3. The portable ski and/or snowboard edge sharpener of claim 1 further comprising a stepped slot control mechanism permitting selective adjustment of said angle between said tilt plate and said base plate.

4. The portable ski and/or snowboard edge sharpener of claim 1 further comprising a tilt angle lock down fastener for setting said angle between said tilt plate and said base plate.

5. The portable ski and/or snowboard edge sharpener of claim 1 further comprising a grinding wheel guard and vacuum assembly surrounding said grinding wheel for collecting grinding residue.

6. The portable ski and snowboard edge sharpener of claim 1 further comprising handles extending from opposite sides of said case.

7. A portable ski and/or snowboard edge sharpener comprising:

a battery positioned at least partially within a case;

a base plate beneath said case;

a grinding wheel;

a motor for driving said grinding wheel; and an edge guide for guiding an edge of a subject ski or snowboard into contact with said grinding wheel, said edge guide movably joined to said base plate such that an angle between coplanar surfaces of said edge guide and said base plate may be adjusted and set.

8. The portable ski and/or snowboard edge sharpener of claim 7 further comprising an edge guide slide positioned within an edge guide slot, said edge guide slide for adjusting said angle between coplanar surfaces of said edge guide and said base plate.

9. The portable ski and/or snowboard edge sharpener of claim 7 further comprising:

an edge guide slide; and an edge guide slide adjustment screw passing through a slot in said edge guide slide and into said edge guide for setting said angle between coplanar surfaces of said edge guide and said base plate.

10. The portable ski and/or snowboard edge sharpener of claim 7 further comprising a tilt plate above and proximate to said base plate and supporting said case and said grinding wheel, said tilt plate selectively movable about one end thereof such that an angle between said tilt plate and said base plate and a vertical angle between said grinding wheel and an edge of said subject ski or snowboard may be selectively adjusted and set.

11. The portable ski and/or snowboard edge sharpener of claim 7 further comprising a grinding wheel guard and vacuum assembly surrounding said grinding wheel for collecting grinding residue.

12. The portable ski and/or snowboard edge sharpener of claim 7 further comprising handles extending from opposite sides of said case.

13. A portable ski and/or snowboard edge sharpener comprising:

a battery, drive assembly and motor positioned at least partially within a case;

a base plate beneath said case;

a grinding wheel;

a motor for driving said grinding wheel; and an edge guide for guiding an edge of a subject ski or snowboard into contact with said grinding wheel, said edge guide movably joined to said base plate such that a distance between coplanar surfaces of said edge guide and said base plate may be adjusted and set to alter depth of cut that the grinding wheel makes on an edge of said subject ski or snowboard.

14. The portable ski and/or snowboard edge sharpener of claim 13 further comprising an adjustment screw passing through said edge guide and into contact with said base plate, said adjustment screw for changing said distance between said coplanar surfaces of said edge guide and said base plate.

15. The portable ski and/or snowboard edge sharpener of claim 13 further comprising a hinge return spring attached to an edge guide hinge and said base plate, said hinge return spring configured to pull said edge guide hinge for maintaining a space between said coplanar surfaces of said edge guide and said base plate.

16. The portable ski and/or snowboard edge sharpener of claim 13 further comprising a tilt plate above and proximate to said base plate and supporting said case and said grinding wheel, said tilt plate selectively movable about one end thereof such that an angle between said tilt plate and said base plate and a vertical angle between said grinding wheel and said edge of said subject ski and/or snowboard may be selectively adjusted and set.

17. The portable ski and/or snowboard edge sharpener of claim 13 further comprising a grinding wheel guard and vacuum assembly surrounding said grinding wheel for collecting grinding residue.

18. The portable ski and/or snowboard edge sharpener of claim 13 further comprising handles extending from opposite sides of said case.

19. A portable ski and/or snowboard edge sharpener comprising:

a base plate beneath said case;

a grinding wheel;

a motor for driving said grinding wheel;

a vacuum system to collect grinding residue;

an edge guide proximate to said base plate, said edge guide for guiding an edge of a subject ski or snowboard into contact with said grinding wheel;

a rechargeable battery positioned at least partially within said case; and a pair of handles allowing a user to control said portable ski and/or snowboard edge sharpener.

20. A portable ski and/or snowboard edge sharpener comprising:

a case;

a battery;

a base plate;

a grinding wheel;

a motor for driving said grinding wheel;

an edge guide for guiding an edge of a subject ski or snowboard into contact with said grinding wheel; and a tilt plate above and proximate to said base plate and supporting said case and grinding wheel.

21. A portable ski and/or snowboard edge sharpener comprising:

a case;

a battery;

a base plate beneath said case;

a grinding wheel;

a motor for driving said grinding wheel; and an edge guide for guiding an edge of a subject ski or snowboard into contact with said grinding wheel, said edge guide movably joined to said base plate such that an angle between coplanar surfaces of said edge guide and said base plate may be adjusted and set.

* * * * *